US009221473B2

(12) United States Patent
Jung et al.

(10) Patent No.: US 9,221,473 B2
(45) Date of Patent: Dec. 29, 2015

(54) TRAVEL VELOCITY COMPENSATION APPARATUS AND METHOD FOR RAILWAY VEHICLES

(71) Applicant: LSIS CO., LTD., Anyang-si, Gyeonggi-do (KR)

(72) Inventors: Jong Chul Jung, Seoul (KR); Yong Gee Cho, Seoul (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 127 days.

(21) Appl. No.: 13/893,213

(22) Filed: May 13, 2013

(65) Prior Publication Data

US 2013/0320153 A1 Dec. 5, 2013

(30) Foreign Application Priority Data

May 29, 2012 (KR) ..... 10-2012-0056635

(51) Int. Cl.
*B60L 3/10* (2006.01)
*B61C 15/08* (2006.01)
*B61C 15/12* (2006.01)

(52) U.S. Cl.
CPC ..... *B61C 15/08* (2013.01); *B61C 15/12* (2013.01)

(58) Field of Classification Search
CPC ..... B60L 3/00; B60L 3/10; B60L 3/102; B60L 3/104; B60L 3/106
USPC ..... 246/167 R, 168, 168.1, 169 R, 182 R
See application file for complete search history.

(56) References Cited

U.S. PATENT DOCUMENTS 5,740,043 A * 4/1998 Wood et al. ..... 701/71
2005/0143949 A1 6/2005 Hagstedt

FOREIGN PATENT DOCUMENTS

CN 1738738 2/2006
CN 101320047 12/2008

OTHER PUBLICATIONS

Ding, et al., "Estimation of vehicle speed based on Kalman filter and ABS control inputs," Journal of Beijing University of Aeronautics and Astronautics, vol. 37, No. 1, Jan. 2011, 5 pages.
The State Intellectual Property Office of the People's Republic of China Application Serial No. 201310206761.8, Office Action dated Nov. 4, 2014, 7 pages.

* cited by examiner

*Primary Examiner* — R. J. McCarry, Jr.
(74) *Attorney, Agent, or Firm* — Lee, Hong, Degerman, Kang & Waimey

(57) ABSTRACT

Disclosed is a travel velocity compensation apparatus for railway vehicles and a method thereof for compensating a travel velocity when there is generated a slide between a wheel and a railway, the apparatus including a velocity measurement unit measuring a travel velocity of a railway vehicle, a velocity estimation unit estimating the travel velocity using travel information of railway vehicle and rail information received from at least one sensor, a detection unit generating wheel slide information by determining whether wheels of the railway vehicle slide, using the travel velocity of the railway vehicle measured by the velocity measurement unit and the travel velocity estimated by the velocity estimation unit, and a selection unit selecting, as a travel velocity, any one of the travel velocity measured by the velocity measurement unit using the wheel slide information generated by the detection unit and the travel velocity estimated by the velocity estimation unit.

16 Claims, 4 Drawing Sheets

TRAVEL VELOCITY COMPENSATION APPARATUS AND METHOD FOR RAILWAY VEHICLES

CROSS-REFERENCE TO RELATED APPLICATIONS

Pursuant to 35 U.S.C. §119(a), this application claims the benefit of earlier filing date and right of priority to Korean Patent Application No. 10-2012-0056635, filed on May 29, 2012, the contents of which are hereby incorporated by reference in their entirety.

BACKGROUND OF THE INVENTION

1. Field of the Invention

The present disclosure relates to a travel velocity compensation apparatus for railway vehicles and a method thereof, and more particularly to an apparatus for compensating a travel velocity of a railway vehicle during generation of slide between a wheel of a railway vehicle and a rail, and a method thereof.

2. Description of Related Art

In general, wheels of a railway vehicle and a rail are all made of steel material, and prone to generate a slide (or skip) phenomenon during braking of a railway vehicle due to smaller adhesion coefficient between the wheel and the rail. The slide phenomenon is generated, in a case a braking force is greater than an adhesion coefficient between a wheel of a railway vehicle and a rail, where the wheel fails to rotate but slides due to lock-up state of the wheel. Thus, in a case the slide is generated, a braking distance of a railway vehicle is lengthened to wear the wheel due to friction between the wheel and rail.

In general, a wheel slide is detected by comparing values of four speed sensors mounted on a wheel axis of railway vehicle and values of four speed sensors mounted on an adjacent railway vehicle. That is, a rotating velocity of a wheel and a travel velocity of a railway vehicle are calculated by using a pulse signal measured by a sensor while the wheel axis of a railway vehicle is rotated, a braking force is calculated by using an air pressure data measured by a braking cylinder, and the slide is measured by measurement of a braking air pressure.

However, the abovementioned method suffers from disadvantages in that the slide phenomenon cannot be detected due to there being no difference in the signals measured by the four speed sensors, in a case the slide is simultaneously generated on wheel axes of four railway vehicles because four speed sensors are used.

In general, velocity of a railway vehicle is calculated by using counts of a tachometer mounted on a wheel axis. There are two methods calculating the velocity of railway vehicle. That is, one is to use information of a tachometer mounted on a wheel axis of a railway vehicle, and the other is to obtain a travel velocity of a railway vehicle by integrating acceleration information measured by an accelerometer.

The method of using the information of a tachometer mounted on a wheel axis of a railway vehicle is configured such that a tachometer counts revolution of a wheel while the wheel connected to the wheel axis of the railway vehicle is rotated, an angular velocity of the wheel is obtained from the counted information, and the velocity of the railway vehicle is calculated by multiplying the angular velocity by wheel radius.

However, there occurs a problem in that, the velocity of a railway vehicle cannot be calculated using the angular velocity of the wheel, because the wheel slides due to lock-up state of the wheels, in a case a slide is generated on the wheels. That is, in a case slide is generated, the wheels are not rotated to cause a travel velocity of a railway vehicle to be calculated as zero (0), which in turn generates a big error in calculation of velocity of a railway vehicle.

The method of obtaining a travel velocity of a railway vehicle by integrating acceleration information measured by an accelerometer is disadvantageous in that noise from a sensor during measurement is also integrated during calculation of velocity of a railway vehicle, resulting in deteriorated accuracy.

SUMMARY OF THE INVENTION

Exemplary aspects of the present disclosure are to substantially solve at least the above problems and/or disadvantages and to provide at least the advantages as mentioned below. Thus, the present disclosure is directed to provide a travel velocity compensation apparatus for railway vehicles configured to calculate an accurate travel velocity of a railway vehicle by detecting generation of a slide on a wheel of the railway vehicle and compensating the travel velocity of the railway vehicle that is generated in the slide, and a travel velocity compensation method for railway vehicles using the same.

The present disclosure is also directed to provide a travel velocity compensation apparatus for railway vehicles configured to calculate a travel distance of a railway vehicle using a compensated travel velocity of the railway vehicle, and a travel velocity compensation method for railway vehicles using the same.

Technical problems to be solved by the present disclosure are not restricted to the above-mentioned descriptions, and any other technical problems not mentioned so far will be clearly appreciated from the following description by skilled in the art.

In one general aspect of the present invention, there is provided a travel velocity compensation apparatus for railway vehicles, the apparatus comprising: a velocity measurement unit measuring a travel velocity of a railway vehicle; a velocity estimation unit estimating the travel velocity using travel information of railway vehicle and rail information received from at least one sensor; a detection unit generating wheel slide information by determining whether wheels of the railway vehicle slide, using the travel velocity of the railway vehicle measured by the velocity measurement unit and the travel velocity estimated by the velocity estimation unit; and a selection unit selecting, as a travel velocity, any one of the travel velocity measured by the velocity measurement unit using the wheel slide information generated by the detection unit and the travel velocity estimated by the velocity estimation unit.

Preferably, but not necessarily, the velocity estimation unit may include a model generation unit generating a dynamic model of a railway vehicle using the travel information and the rail information, and a non-linear observation unit non-linearly observing the travel velocity of the railway vehicle using the generated dynamic model.

Preferably, but not necessarily, the travel information of railway vehicle may include at least one of acceleration information and braking force information of the railway vehicle.

Preferably, but not necessarily, the railway information may include at least one of railway grade information and railway curvature information.

Preferably, but not necessarily, the velocity measurement unit may measure a revolution count of a wheel using a pulse received from a tachometer, obtains an angular velocity of the wheel using the measured revolution count, and measures the travel velocity of railway vehicle by multiplying the angular velocity by a wheel radius of the railway vehicle.

Preferably, but not necessarily, the dynamic model of the railway vehicle generated by the model generation unit may be obtained by the following equation.

$$m\frac{dv}{dt} = -T_b - R_r - R_g - R_c + w$$

where, m is train equivalent mass, v is a train longitudinal speed, Tb is a braking force, Rr is a running resistance, Rg is a grade resistance, Rc is a curving resistance, and w is process noise.

Preferably, but not necessarily, the detection unit may calculate a slip rate using the measured velocity and the estimated velocity, and determines that the wheel slides in a case the slip rate is deviated from a predetermined scope.

Preferably, but not necessarily, the slip rate may be calculated using the following equation.

$$s = \frac{\text{estimated velocity} - \text{measured velocity}}{\text{estimated velocity}}$$

Preferably, but not necessarily, the apparatus may further comprise a distance calculation unit measuring a travel distance of a railway vehicle using the travel velocity selected by the selection unit.

In another general aspect of the present disclosure, there is provided a travel velocity compensation method for railway vehicles, the method comprising: measuring a travel velocity of a railway vehicle; estimating the travel velocity using travel information of railway vehicle and rail information received from at least one or more sensors; generating wheel slide information by determining whether wheels of the railway vehicle slide, using the measured travel velocity of the railway vehicle and the estimated travel velocity; and selecting, as a travel velocity, any one of the measured travel velocity using the generated wheel slide information and the estimated travel velocity.

Preferably, but not necessarily, the step of estimating the travel velocity may include generating a dynamic model of a railway vehicle using the travel information and the rail information, and non-linearly observing the travel velocity of the railway vehicle using the generated dynamic model.

Preferably, but not necessarily, the travel information of railway vehicle may include at least one of acceleration information and braking force information of the railway vehicle.

Preferably, but not necessarily, the railway information may include at least one of railway grade information and railway curvature information.

Preferably, but not necessarily, the step of measuring the travel velocity of railway vehicle may include measuring a revolution count of a wheel using a pulse received from a tachometer, obtaining an angular velocity of the wheel using the measured revolution count, and measuring the travel velocity of railway vehicle by multiplying the angular velocity by a wheel radius of the railway vehicle.

Preferably, but not necessarily, the dynamic model of the railway vehicle may be obtained by the following equation.

$$m\frac{dv}{dt} = -T_b - R_r - R_g - R_c + w$$

where, m is train equivalent mass, v is a train longitudinal speed, Tb is a braking force, Rr is a running resistance, Rg is a grade resistance, Rc is a curving resistance, and w is process noise.

Preferably, but not necessarily, whether wheels of the railway vehicle slide in the step of generating the wheel slide information may be determined by calculating a slip rate using the measured velocity and the estimated velocity, and by determining that the wheel slides, in a case the slip rate is deviated from a predetermined scope.

Preferably, but not necessarily, the slip rate may be calculated using the following equation.

$$s = \frac{\text{estimated velocity} - \text{measured velocity}}{\text{estimated velocity}}$$

Preferably, but not necessarily, the method may further comprise measuring a travel distance of a railway vehicle using the travel velocity selected from selecting step of the travel velocity.

In an advantageous effect, the travel velocity compensation apparatus and for railway vehicles and the method thereof according to the exemplary embodiments of the present disclosure can detect a wheel slide while a braking force is being applied to the railway vehicle, and a detected signal is transmitted to a braking device of the railway vehicle to provide an adequate braking to the railway vehicle.

In another advantageous effect, comparison is made between a travel velocity of railway vehicle measured on a base of a revolution count of a wheel with a travel velocity estimated on a base of acceleration, in a case slide is generated on the wheel, whereby an adequate travel velocity during wheel sliding can be provided to a control device of the railway vehicle.

In still another advantageous effect, the velocity can be compensated even during the wheel sliding to enable an accurate calculation of position of the railway vehicle.

In still further advantageous effect, the travel velocity of railway vehicle can be non-linearly observed based on a dynamic model of the railway vehicle to remove an external noise during calculation of an acceleration sensor-based velocity and to enhance accuracy of an estimated velocity of railway vehicle.

BRIEF DESCRIPTION OF THE DRAWINGS

The teachings of the present disclosure can be readily understood by considering the following detailed description in conjunction with the accompanying drawings, in which.

DETAILED DESCRIPTION OF THE INVENTION

Figure 1:
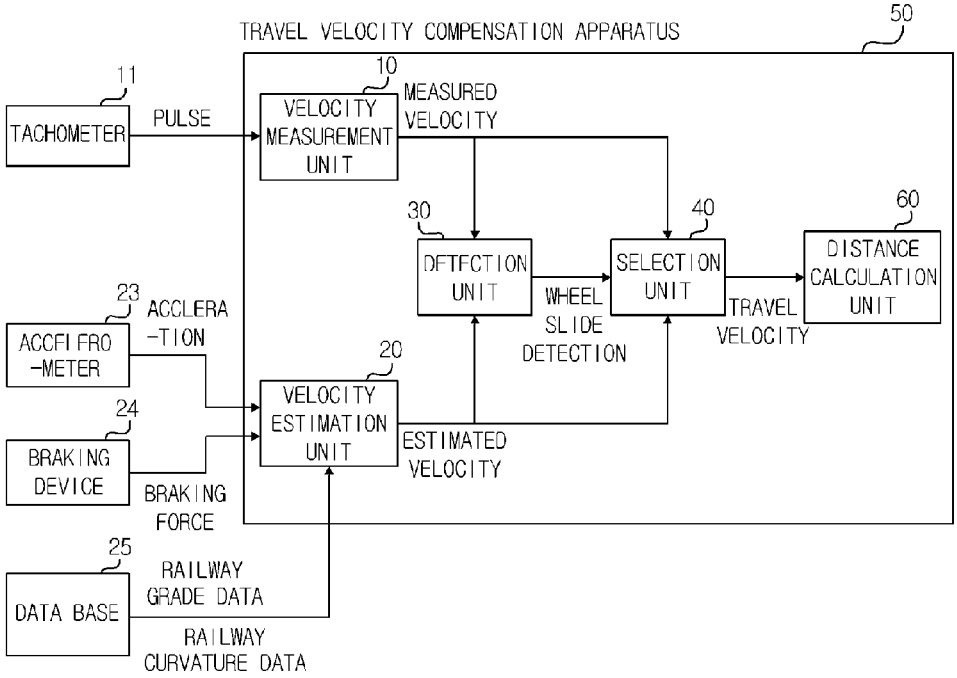
FIG. 1 is a block diagram illustrating a travel velocity compensation apparatus for railway vehicles according to the present disclosure.

Various exemplary embodiments will be described more fully hereinafter with reference to the accompanying drawings, in which some exemplary embodiments are shown. The present inventive concept may, however, be embodied in many different forms and should not be construed as limited to the example embodiments set forth herein. Rather, the described aspect is intended to embrace all such alterations, modifications, and variations that fall within the scope and novel idea of the present disclosure.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concept.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, the term of 'railway vehicle' and 'train' may be interchangeably used. Furthermore, 'travel velocity of railway vehicle (train)' and 'train speed' may be interchangeably used for convenience sake.

Now, exemplary embodiments of the present disclosure will be explained in detail together with the figures, where like numerals refer to like elements throughout.

The present disclosure relates to an apparatus configured to detect a wheel slide by non-linearly observing a dynamic model of a railway vehicle and a travel velocity of the railway vehicle and to compensate the travel velocity while the wheel slide is generated.

FIG. 1 is a block diagram illustrating a travel velocity compensation apparatus for railway vehicles according to the present disclosure.

Referring to FIG. 1, a travel velocity compensation apparatus 50 for railway vehicles according to the present disclosure includes a velocity measurement unit 10, a velocity estimation unit 20, a detection unit 30, a selection unit 40 and a distance calculation unit 60.

The velocity measurement unit 10 calculates a train speed (travel velocity of a railway vehicle) based on a pulse by receiving a pulse input from a tachometer 11. That is, the train speed may be calculated by the following equation 1 using the number of pulses and a wheel radius.

$$\text{Measured velocity} = r_w \times \omega \qquad \text{[Equation 1]}$$

$$\text{Measured velocity} = \frac{2\pi r_w}{\text{seconds}} \times \frac{\text{pulse number}}{\text{pulse number per revolution}}$$

where, $r_w$ is a wheel radius, 'ω' is an angular velocity (rad/sec).

The velocity estimation unit 20 estimates the train speed by non-linearly observing the train speed.

First, the velocity estimation unit 20 receives acceleration information from an accelerometer 23 installed on the railway vehicle, braking information provided from the braking device 24 installed on the railway vehicle, a railway grade data and a railway curvature data provided from a database 25 installed on the railway vehicle, details of which will be described with reference to FIG. 2.

Figure 2:
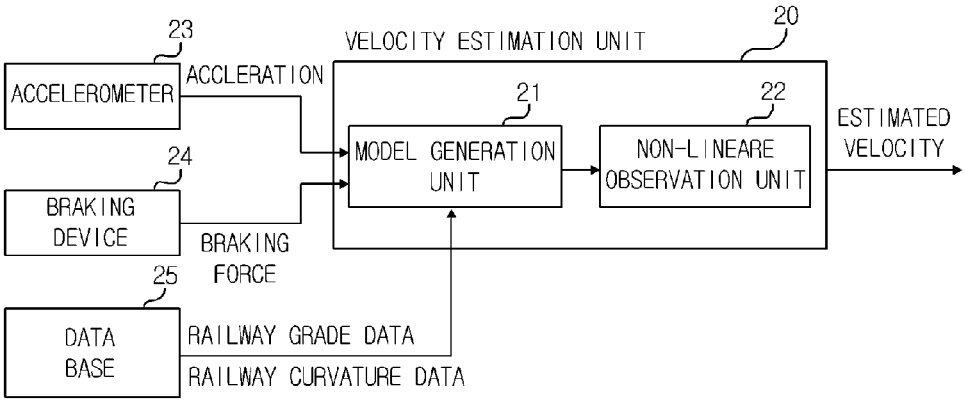
FIG. 2 is a detailed block diagram illustrating a velocity estimation unit of FIG. 1.

FIG. 2 is a detailed block diagram illustrating a velocity estimation unit of FIG. 1.

Referring to FIG. 2, the velocity estimation unit 20 includes a model generation unit 21 and a non-linear observation unit 22. The model generation unit 21 generates a dynamic model based on a longitudinal model of the railway vehicle. The non-linear observation unit 22 estimates the train speed by non-linearly observing the train speed using a dynamic model of the railway vehicle generated by the model generation unit 21 and a measured value inputted from sensors, details of which will be described later.

The model generation unit 21 may generate the dynamic model of a railway vehicle based on Newton's second law using the following equation 2.

$$m\frac{dv}{dt} = -T_b - R_r - R_g - R_c + w \qquad \text{[Equation 2]}$$

where, 'm' is a train equivalent mass, 'v' is a train longitudinal speed, 'Tb' is a braking force, 'Rr' is a running resistance formed by a sum of a rolling resistance and an aerodynamic drag. 'Rg' is a grade resistance, and 'Rc' is a curving resistance. Furthermore, 'w' is a process noise that may be defined by a modeling error or a disturbance.

The train equivalent mass 'm' is defined by an assumption that a train total mass is the train equivalent mass, and railway vehicles forming a train are a lumped mass, although a train is substantially formed by connecting several railway vehicles. The braking force 'Tb' is received from the braking device.

The running resistance 'Rr' is expressed by a sum of a rolling resistance and an aerodynamic drag, and may be modeled in a quadratic equation relative to the velocity as defined by the following equation 3.

$$R_r = c_1 + c_2 v + c_3 v^2 \qquad \text{[Equation 3]}$$

where, c1, c2 and c3 are constants, a second term to velocity relates to an expression to aerodynamic drag, and a first term to velocity and constant term relate to an expression to the rolling resistance. The grade resistance is an expression of relation to the train equivalent mass and grade resistance, which may be calculated by the following equation 4.

$$R_g = mg\theta \quad \text{[Equation 4]}$$

where, 'm' is a train equivalent mass, 'g' is a gravitational acceleration, and 'θ' is a grade angle (tilt angle). That is, in case there is no grade, the grade resistance may be neglected. The grade angle of a rail is dependent on a travel distance of a train. Furthermore, the curving resistance is a function to radius of rail curvature, and may be calculated by the following equation 5.

$$R_c = c_4/r \quad \text{[Equation 5]}$$

where, 'c4' is a constant, and the curvature radius 'r' may have a different value according to travel distance of a train, and is dependent on the travel distance of the train. If Equations 3, 4 and 5 substitute Equation 2, Equation 2 may be expressed by the following equation 6.

$$m\frac{dv}{dt} = -T_b - c_1 - c_2 v - c_3 v^2 - mg\theta - c_4/r + w \quad \text{[Equation 6]}$$

The acceleration measured by a sensor of the accelerometer 23 may be modeled by the following equation 7.

$$y = \frac{1}{m}[-T_b - c_1 - c_2 v - c_3 v^2 - mg\theta - c_4/r] + d \quad \text{[Equation 7]}$$

where, y' is a measured value of the accelerometer 23, and is a sensing noise. If acceleration is measured by a sensor, the sensing noise may be included, and if a velocity is obtained by integrating acceleration information included with the sensing noise, accuracy of travel velocity of a railway vehicle may deteriorate due to the sensing noise. If the dynamic model is discretized, it may be expressed by the following equation 8.

$$v(k) = v(k-1) + \frac{\Delta T}{m}[-T_b(k-1) - c_1 - c_2 v(k-1) - c_3 v(k-1)^2 - mg\theta(k-1) - c_4/r(k-1)] + w(k-1) \quad \text{[Equation 8]}$$

where, ΔT' is a sampling period.

Figure 3:
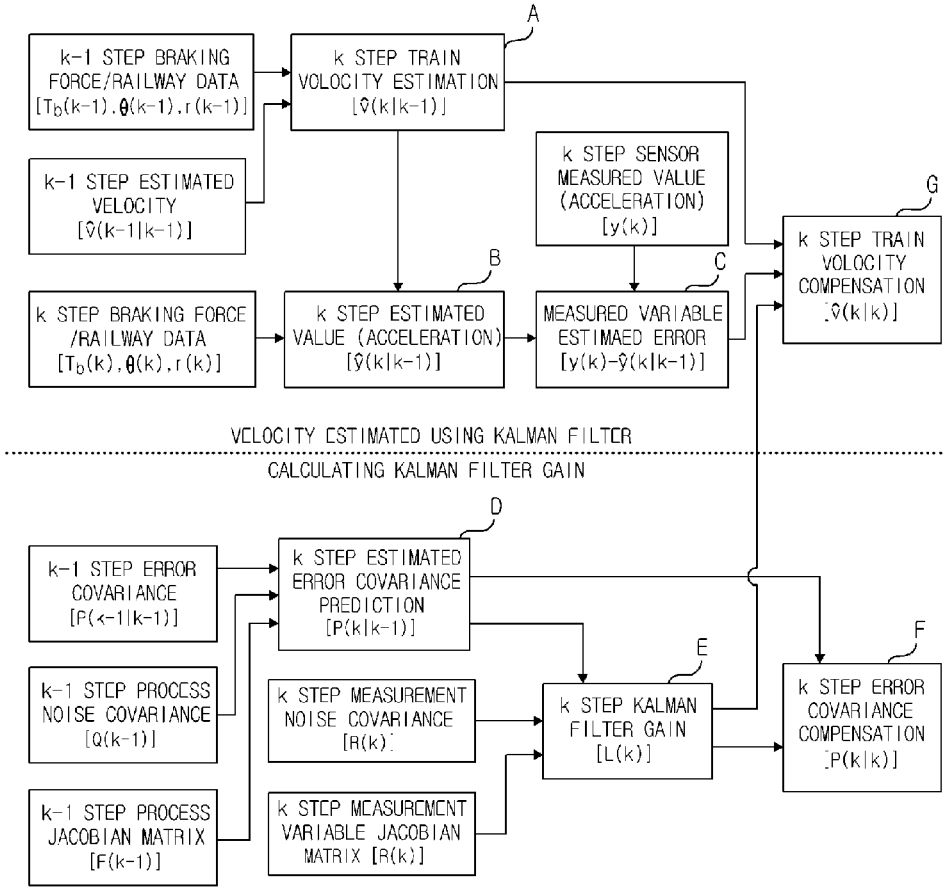
FIG. 3 is a detailed block diagram illustrating a non-linear observation of a non-linear observation unit of FIG. 2 according to an exemplary embodiment of the present disclosure.

FIG. 3 is a detailed block diagram illustrating a non-linear observation of a non-linear observation unit of FIG. 2 according to an exemplary embodiment of the present disclosure.

Referring to FIG. 3, the non-linear observation unit 22 non-linearly observes the train speed based on the dynamic model generated by the model generation unit 21. The non-linear observation unit 22 estimates the train speed by non-linearly observing the train speed using a dynamic model of the railway vehicle generated by the model generation unit 21.

Several methods are available for estimating a state variable in a non-linear system, and the train speed is estimated in the present disclosure using a simply designable 'Extended Kalman filter'. However, it should be apparent that the Extended Kalman filter is exemplary, the present disclosure is not limited to the Extended Kalman filter, and other observation methods may be used to estimate the travel velocity of the railway vehicle.

Referring to FIG. 3 again, the method of estimating the train speed using the Extended Kalman filter is as per the following equation 9.

$$\hat{v}(k \mid k-1) = \hat{v}(k-1) \mid k-1) + \frac{\Delta T}{m}[-c_2\hat{v}(k-1 \mid k-1) - c_3\hat{v}(k-1 \mid k-1)^2] + \frac{\Delta T}{m}[-T_b(k-1) - c_1 - mg\theta(k-1) - c_4/r(k-1)] \quad \text{[Equation 9]}$$

The equation 9 is an equation estimating the train speed at k step (current step), which may be calculated as under:

A) A train speed ($\hat{v}(k|k-1)$) at k step (current step) may be predicted by using k−1 step (previous step) braking force (Tb(k−1)), railway data(θ(k−1), r(k−1)) and k−1 step estimation velocity ($\hat{v}(k|k-1)$).

$$\hat{v}(k \mid k-1) = \frac{1}{m}[-T_b(k) - c_1 - mg\theta(k) - c_4/r(k) - c_2\hat{v}(k \mid k-1) - c_3\hat{v}(k \mid k-1)^2] \quad \text{[Equation 10]}$$

The equation 10 is an equation obtaining a predicted acceleration as k step in the following manner.

B) A predicted acceleration ($\hat{y}(k|k-1)$) at k step is obtained using a train speed ($\hat{v}(k|k-1)$) predicted at k step, a braking force (Tb(k)) at k step, and railway data (θ(k),r(k)).

C) A measurement variable estimated error ($y(k)-\hat{y}(k|k-1)$) (which is a difference between a measurement value and a predicted value) is obtained by using a difference between a predicted value (acceleration: $\hat{y}(k|k-1)$) at k step and a measurement value (acceleration: y(k)) measured by a physical sensor at k step.

$$P(k|k-1) = F(k-1)P(k-1|k-1)F(k-1)^T + Q(k-1) \quad \text{[Equation 11]}$$

Equation 11 is an equation predicting an estimated error covariance at k step, which is calculated by the following method.

D) The estimated error covariance at k step is predicted by using an error covariance (P(k−1|k−1)) at k−1 step, a process noise covariance at k−1 step (Q(k−1)), a process Jacobian matrix (F(k−1)) and a process noise error covariance (Q(k−1)).

$$L(k) = P(k|k-1)H(k)^T(H(k)P(k|k-1)H(k)^T + R(k))^{-1} \quad \text{[Equation 12]}$$

Equation 12 is an equation obtaining a Kalman filter gain at k step, which is calculated by the following manner.

E) The Kalman filter gain at k step (L(k)) is obtained by using an estimated error covariance at k step (P(k|k−1)), a measurement noise covariance at k step (R(k)) and a measurement variable Jacobian matrix at k step (H(k)).

$$P(k|k) = (I - L(k)H(k))P(k|k-1) \quad \text{[Equation 13]}$$

Equation 13 is an equation compensating an estimated error covariance at k step, which is calculated in the following manner.

F) The estimated error covariance at k step is compensated P(k|k)) at k step is compensated by using an estimated error covariance at k step (P(k|k−1)), a Kalman filter gain at k step (L(k)), and a Jacobian matrix (H(k)) relative to state variable an identity matrix (I) and a measurement variable (y(k). The measurement value y(k) is an acceleration sensing value obtained by an accelerometer 23 mounted on the train.

$$\hat{y}(k|k) = \hat{y}(k|k-1) + L(k)(y(k) - \hat{y}(k|k-1)) \quad \text{[Equation 14]}$$

Equation 14 is an equation compensating a train speed at k step, which is calculated in the following manner.

G) The train speed at k step ($\hat{v}(k|k-1)$) is compensated by using a measurement variable estimation error at k step ($y(k)-\hat{v}(k|k-1)$), a Kalman filter gain at k step ($L(k)$) and a train speed estimated at k step ($\hat{v}(k|k-1)$).

That is, a speed at current step is predicted using a railway data including a braking force at previous step, curvature and inclination, and the predicted train speed is compensated by using an estimation error with the measurement variable based on a measurement value obtained by the acceleration sensor and the predicted speed value. At this time, the compensation is obtained by adding to the predicted value by as much as a value in which the estimation error is multiplied by the Kalman filter gain.

The travel velocity of railway vehicle can be estimated based on acceleration using a Kalman filter extended by sequential calculation from Equations 9 to 14.

Furthermore, the abovementioned processes are repeated to estimate the speed at next steps. That is, the current speed is estimated by repeating steps from k−1 to the current step.

The travel velocity of railway vehicle thus estimated can be a value robust to sensing noise or disturbance. After all, an estimated velocity estimated by non-linearly observing the travel velocity of railway vehicle becomes $\hat{v}(k|k)$.

Meantime, the detection unit 30 can determine whether the train has slided based on a difference between the train speed measured by using a tachometer 11 and an estimated train speed obtained by the extended Kalman filter design, whereby wheel slide information can be outputted.

In order to determine the wheel slide, a slip ratio of a wheel is calculated using a measured velocity and estimated velocity, and if the slip ratio is over a predetermined set value, a train is determined to have slipped. The slip ratio can be obtained by the following equation 15.

$$s = \frac{\text{estimated velocity} - \text{measured velocity}}{\text{estimated velocity}} \quad \text{[Equation 15]}$$

where, 's' is a slip ratio of a wheel, and if the slip ratio is 1, it means that a wheel slides or slips to advance forward without rotation, and if the slip ratio is zero (0), it means that the wheel rotates without slide. Whether a wheel slides or not is determined based on the slip ratio calculated from Equation 15, and the wheel is generally determined to slide, if a set value is 0.2~0.3 or more. However, the set value must be determined later in response to state of each railway vehicle.

Now, a travel velocity compensation method for railway vehicles according to the present disclosure corresponding to the travel velocity compensation apparatus for railway vehicles according to the present disclosure will be described step by step with reference to FIG. 4.

Figure 4:
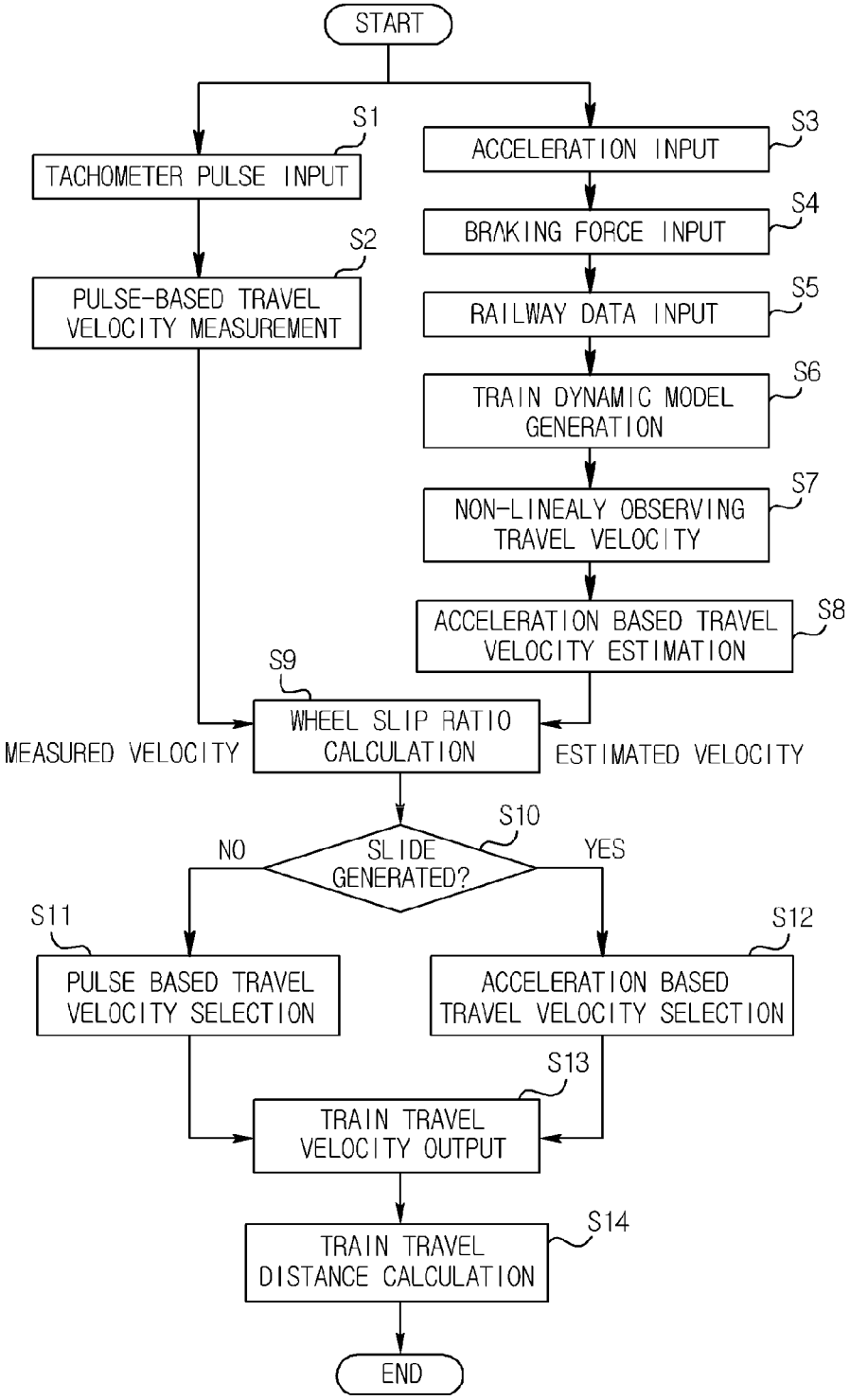
FIG. 4 is a flowchart illustrating a travel velocity compensation method for railway vehicles according to the present disclosure.

FIG. 4 is a flowchart illustrating a travel velocity compensation method for railway vehicles according to the present disclosure, where the travel velocity can be compensated by the following two methods.

Referring to FIG. 4, a first method is to measure a pulse-based travel velocity using pulse information received from the tachometer 11 and wheel radius information (S1~S2).

A second method is to generate a train dynamic model using a railway data including an acceleration value measured by an accelerometer 23, a braking force provided by a braking device 24, a railway grade data provided from data base 25 and a railway curvature data (S3~S6).

Thereafter, in order to estimate the travel velocity based on the train dynamic model, a travel velocity is non-linearly observed (S7), and acceleration based travel velocity is estimated using the acceleration information and braking force information (S8).

Successively, the estimated velocity and the measured velocity are compared to calculate the slip ratio during the braking (S9), and determination is made whether slide has occurred based on the calculated wheel slip ratio (S10).

At the step S10, if the slide has occurred according to the calculated wheel slip ratio, an acceleration based travel velocity is selected using the velocity information estimated by non-linear observation (S12), and the travel velocity is compensated by outputting the travel velocity of the railway vehicle (S13).

However, if no slide is generated at the step S10 according to the calculated wheel slip ratio, a pulse based travel velocity is selected (S11) and the travel velocity is compensated by outputting the travel velocity (S13).

Furthermore, the distance calculation unit 60 can calculate a travel distance ($x(t)$) by substituting the compensated travel velocity to the following equation 16 (S14).

$$x(t)=x(0)+\int_0 \hat{v}(k|k)dk \quad \text{[Equation 16]}$$

where, $x(0)$ is an initial position of a railway vehicle.

The above-mentioned travel velocity compensation apparatus and method for railway vehicles according to the exemplary embodiment of the present disclosure may, however, be embodied in many different forms and should not be construed as limited to the embodiment set forth herein. Thus, it is intended that embodiment of the present disclosure may cover the modifications and variations of this disclosure provided they come within the scope of the appended claims and their equivalents. While particular features or aspects may have been disclosed with respect to several embodiments, such features or aspects may be selectively combined with one or more other features and/or aspects of other embodiments as may be desired.

What is claimed is:

1. A travel velocity compensation apparatus for railway vehicles, the apparatus comprising:

a velocity measurement unit configured to measure a travel velocity of a railway vehicle based on a pulse received from a tachometer;

a velocity estimation unit configured to estimate the travel velocity using travel information of railway vehicle and rail information received from at least one sensor, wherein the travel information of railway vehicle includes at least one of acceleration information or braking force information of the railway vehicle;

a detection unit configured to generate wheel slide information by determining whether wheels of the railway vehicle slide, using the travel velocity of the railway vehicle measured by the velocity measurement unit and the travel velocity estimated by the velocity estimation unit; and a selection unit configured to select based on the generated wheel slide information, one of the travel velocity measured by the velocity measurement unit or the travel velocity estimated by the velocity estimation unit as the travel velocity of the railway vehicle.

2. The apparatus of claim 1, wherein the velocity estimation unit includes a model generation unit generating a dynamic model of a railway vehicle using the travel information and the rail information, and a non-linear observation unit non-linearly observing the travel velocity of the railway vehicle using the generated dynamic model.

3. The apparatus of claim 2, wherein the railway information includes at least one of railway grade information or railway curvature information.

4. The apparatus of claim 2, wherein the dynamic model of the railway vehicle generated by the model generation unit is obtained by the following equation:

$$m\frac{dv}{dt} = -T_b - R_r - R_g - R_c + w$$

where, m is train equivalent mass, v is a train longitudinal speed, Tb is a braking force, Rr is a running resistance, Rg is a grade resistance, Rc is a curving resistance, and w is process noise.

5. The apparatus of claim 1, wherein the velocity measurement unit measures a revolution count of a wheel using the pulse received from the tachometer, obtains an angular velocity of the wheel using the measured revolution count, and measures the travel velocity of railway vehicle by multiplying the angular velocity by a wheel radius of the railway vehicle.

6. The apparatus of claim 1, wherein the detection unit calculates a slip rate using the measured velocity and the estimated velocity, and determines that the wheel slides in a case the slip rate is deviated from a predetermined scope.

7. The apparatus of claim 6, wherein the slip rate is calculated using the following equation:

$$s = \frac{\text{estimated velocity} - \text{measured velocity}}{\text{estimated velocity}}.$$

8. The apparatus of claim 1, further comprising a distance calculation unit measuring a travel distance of a railway vehicle using the travel velocity selected by the selection unit.

9. A travel velocity compensation method for railway vehicles, the method comprising:

measuring a travel velocity of a railway vehicle based on a pulse received from a tachometer;

estimating the travel velocity using travel information of railway vehicle and rail information received from at least one or more sensors, wherein the travel information of railway vehicle includes at least one of acceleration information or braking force information of the railway vehicle;

generating wheel slide information by determining whether wheels of the railway vehicle slide, using the measured travel velocity of the railway vehicle and the estimated travel velocity; and selecting, based on the generated wheel slide information, one of the measured travel or the estimated travel velocity as the travel velocity of the railway vehicle.

10. The method of claim 9, wherein the step of estimating the travel velocity includes:

generating a dynamic model of a railway vehicle using the travel information and the rail information, and nonlinearly observing the travel velocity of the railway vehicle using the generated dynamic model.

11. The method of claim 10, wherein the railway information includes at least one of railway grade information or railway curvature information.

12. The method of claim 10, wherein the dynamic model of the railway vehicle is obtained by the following equation:

$$m\frac{dv}{dt} = -T_b - R_r - R_g - R_c + w$$

where, m is train equivalent mass, v is a train longitudinal speed, Tb is a braking force, Rr is a running resistance, Rg is a grade resistance, Rc is a curving resistance, and w is process noise.

13. The method of claim 9, wherein the step of measuring the travel velocity of railway vehicle includes measuring a revolution count of a wheel using the pulse received from the tachometer, obtaining an angular velocity of the wheel using the measured revolution count, and measuring the travel velocity of railway vehicle by multiplying the angular velocity by a wheel radius of the railway vehicle.

14. The method of claim 9, wherein whether wheels of the railway vehicle slide in the step of generating the wheel slide information is determined by calculating a slip rate using the measured velocity and the estimated velocity, and by determining that the wheel slides, in a case the slip rate is deviated from a predetermined scope.

15. The method of claim 14, wherein the slip rate is calculated using the following equation:

$$s = \frac{\text{estimated velocity} - \text{measured velocity}}{\text{estimated velocity}}.$$

16. The method of claim 9, further comprising measuring a travel distance of a railway vehicle using the travel velocity selected from selecting step of the travel velocity.

* * * * *